US006003964A

United States Patent [19]

Baker

[11] Patent Number: 6,003,964

[45] Date of Patent: Dec. 21, 1999

[54] TOOTHBRUSH CABINET

[76] Inventor: Judy Baker, P.O. Box 899, New Market, Va. 22844

[21] Appl. No.: 09/234,658

[22] Filed: Jan. 21, 1999

[51] Int. Cl.[6] ..... A46B 17/00

[52] U.S. Cl. ..... 312/206; 312/245

[58] Field of Search ..... 312/206, 207, 312/245, 326; 211/65, 66; D6/527, 528, 534, 551, 553, 559

[56] References Cited

U.S. PATENT DOCUMENTS

| | | | |
|---|---|---|---|
| 1,303,884 | 5/1919 | Goodnow, Jr. | 312/206 X |
| 1,507,466 | 9/1924 | Collins | 312/206 X |
| 1,529,024 | 3/1925 | Hoch | 312/206 X |
| 1,735,512 | 11/1929 | Siegel | 312/207 X |
| 2,564,353 | 8/1951 | Coleman | 312/206 |
| 2,608,294 | 8/1952 | Ward | 312/206 X |
| 2,642,331 | 6/1953 | Sprinkle | 312/260 X |
| 3,138,414 | 6/1964 | La Pollo | 312/245 X |
| 3,605,160 | 9/1971 | Maurer | 312/206 X |
| 3,950,049 | 4/1976 | Drass | 312/245 |
| 4,160,570 | 7/1979 | Bridges | 312/245 |
| 4,329,003 | 5/1982 | Manchester | 312/245 |

*Primary Examiner*—Peter M. Cuomo
*Assistant Examiner*—James O. Hansen

[57] ABSTRACT

A toothbrush cabinet for storing toothbrushes therein. The toothbrush cabinet includes a housing with a front opening into the housing. A door pivotally coupled to the housing closes the front opening. A plate is provided in the housing. The plate has upper and lower faces, front and back edges, and a pair of side edges extending between the front and back edges of the plate. The back edges of the plate is detachably attached to a back face of the housing. The plate has a plurality of spaced apart holding slots extending therethrough between the upper and lower faces of the plate adjacent the front edge of the plate. Each of the holding slots has an outer periphery comprising a generally circular portion spaced apart from the front edge of the plate and a generally rectangular portion continuous with the associated circular portion of the respective holding slot and extending between the associated circular portion and the front edge of the plate.

8 Claims, 2 Drawing Sheets

TOOTHBRUSH CABINET

BACKGROUND OF THE INVENTION

1. Field of the Invention

The present invention relates to toothbrush cabinets and more particularly pertains to a new toothbrush cabinet for storing toothbrushes therein.

2. Description of the Prior Art

The use of toothbrush cabinets is known in the prior art. More specifically, toothbrush cabinets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,9298,039 by Thomas et al.; U.S. Pat. No. 1,529,024 by Hoch; U.S. Pat. No. 4,986,759 by Duncan; U.S. Pat. No. 3,776,694 by Leittl; U.S. Pat. No. 3,124,399 by Seta; and U.S. Pat. No. Des. 370,812.

While these devices fulfill their respective, particular objectives and requirements, the aforementioned patents do not disclose a new toothbrush cabinet. The inventive device includes a housing with a front opening into the housing. A door pivotally coupled to the housing closes the front opening. A plate is provided in the housing. The plate has upper and lower faces, front and back edges, and a pair of side edges extending between the front and back edges of the plate. The back edges of the plate is detachably attached to a back face of the housing. The plate has a plurality of spaced apart holding slots extending therethrough between the upper and lower faces of the plate adjacent the front edge of the plate. Each of the holding slots has an outer periphery comprising a generally circular portion spaced apart from the front edge of the plate and a generally rectangular portion continuous with the associated circular portion of the respective holding slot and extending between the associated circular portion and the front edge of the plate.

In these respects, the toothbrush cabinet according to the present invention substantially departs from the conventional concepts and designs of the prior art, and in so doing provides an apparatus primarily developed for the purpose of storing toothbrushes therein.

SUMMARY OF THE INVENTION

In view of the foregoing disadvantages inherent in the known types of toothbrush cabinets now present in the prior art, the present invention provides a new toothbrush cabinet construction wherein the same can be utilized for storing toothbrushes therein.

The general purpose of the present invention, which will be described subsequently in greater detail, is to provide a new toothbrush cabinet apparatus and method which has many of the advantages of the toothbrush cabinets mentioned heretofore and many novel features that result in a new toothbrush cabinet which is not anticipated, rendered obvious, suggested, or even implied by any of the prior art toothbrush cabinets, either alone or in any combination thereof.

To attain this, the present invention generally comprises a housing with a front opening into the housing. A door pivotally coupled to the housing closes the front opening. A plate is provided in the housing. The plate has upper and lower faces, front and back edges, and a pair of side edges extending between the front and back edges of the plate. The back edges of the plate is detachably attached to a back face of the housing. The plate has a plurality of spaced apart holding slots extending therethrough between the upper and lower faces of the plate adjacent the front edge of the plate. Each of the holding slots has an outer periphery comprising a generally circular portion spaced apart from the front edge of the plate and a generally rectangular portion continuous with the associated circular portion of the respective holding slot and extending between the associated circular portion and the front edge of the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothbrush cabinet apparatus and method which has many of the advantages of the toothbrush cabinets mentioned heretofore and many novel features that result in a new toothbrush cabinet which is not anticipated, rendered obvious, suggested, or even implied by any of the prior art toothbrush cabinets, either alone or in any combination thereof.

It is another object of the present invention to provide a new toothbrush cabinet which may be easily and efficiently manufactured and marketed.

It is a further object of the present invention to provide a new toothbrush cabinet which is of a durable and reliable construction.

An even further object of the present invention is to provide a new toothbrush cabinet which is susceptible of a low cost of manufacture with regard to both materials and labor, and which accordingly is then susceptible of low prices of sale to the consuming public, thereby making such toothbrush cabinet economically available to the buying public.

Still yet another object of the present invention is to provide a new toothbrush cabinet which provides in the apparatuses and methods of the prior art some of the advantages thereof, while simultaneously overcoming some of the disadvantages normally associated therewith.

Still another object of the present invention is to provide a new toothbrush cabinet for storing toothbrushes therein.

Yet another object of the present invention is to provide a new toothbrush cabinet which includes a housing with a front opening into the housing. A door pivotally coupled to the housing closes the front opening. A plate is provided in the housing. The plate has upper and lower faces, front and back edges, and a pair of side edges extending between the front and back edges of the plate. The back edges of the plate is detachably attached to a back face of the housing. The plate has a plurality of spaced apart holding slots extending therethrough between the upper and lower faces of the plate adjacent the front edge of the plate. Each of the holding slots has an outer periphery comprising a generally circular portion spaced apart from the front edge of the plate and a generally rectangular portion continuous with the associated circular portion of the respective holding slot and extending between the associated circular portion and the front edge of the plate.

Still yet another object of the present invention is to provide a new toothbrush cabinet that holds toothbrushes upright so that they can properly dry.

Even still another object of the present invention is to provide a new toothbrush cabinet that keeps toothbrushes hidden from sight when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
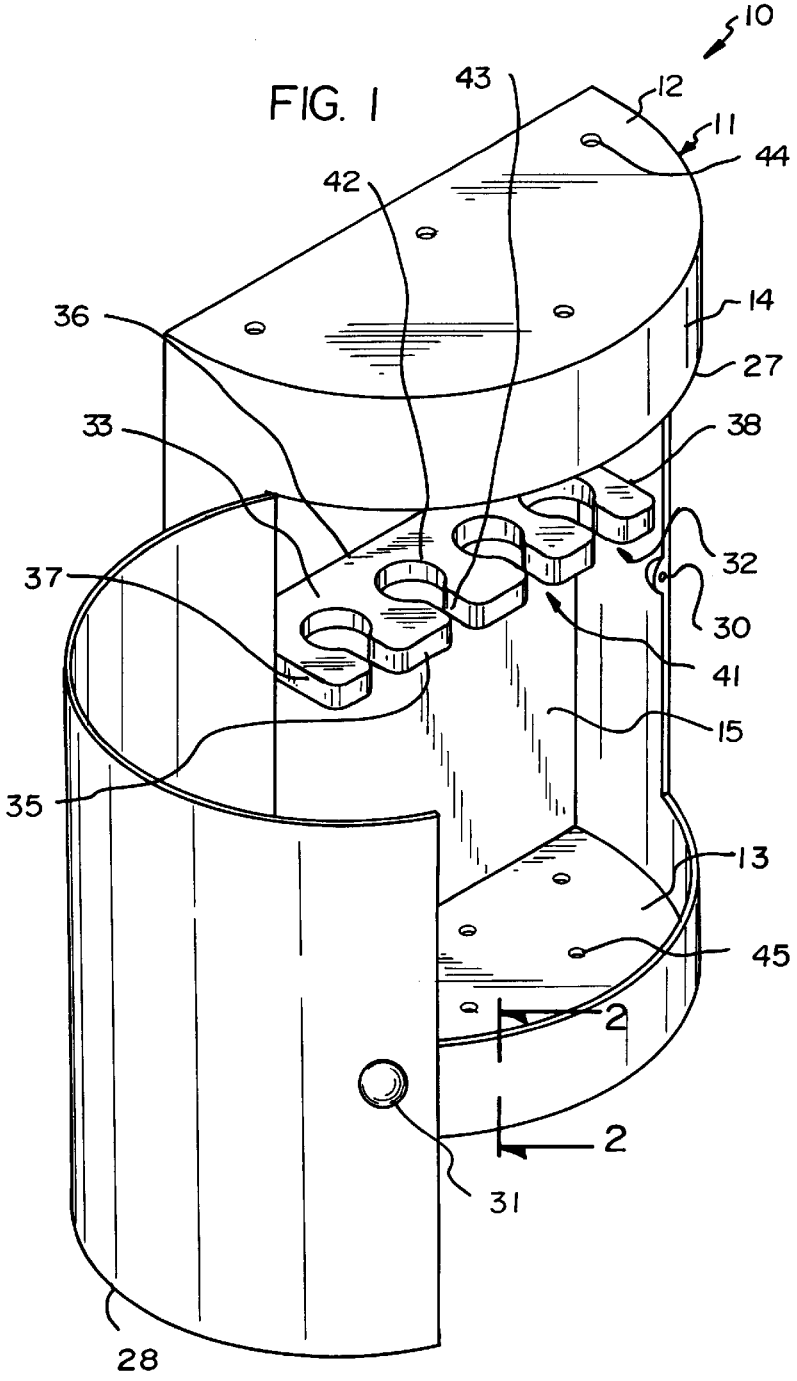
FIG. 1 is a schematic perspective view of a new toothbrush cabinet according to the present invention with the door open to expose the front opening of the housing.

With reference now to the drawings, and in particular to FIGS. 1 through 4 thereof, a new toothbrush cabinet embodying the principles and concepts of the present invention and generally designated by the reference numeral 10 will be described.

As best illustrated in FIGS. 1 through 4, the toothbrush cabinet 10 generally comprises a housing with a front opening into the housing. A door pivotally coupled to the housing closes the front opening. A plate is provided in the housing. The plate has upper and lower faces, front and back edges, and a pair of side edges extending between the front and back edges of the plate. The back edges of the plate is detachably attached to a back face of the housing. The plate has a plurality of spaced apart holding slots extending therethrough between the upper and lower faces of the plate adjacent the front edge of the plate. Each of the holding slots has an outer periphery comprising a generally circular portion spaced apart from the front edge of the plate and a generally rectangular portion continuous with the associated circular portion of the respective holding slot and extending between the associated circular portion and the front edge of the plate.

In closer detail, the toothbrush cabinet 10 comprises a housing 11 having spaced apart top and bottom faces 12,13, and front and back faces 14,15. As illustrated in FIG. 1, preferably, the top and bottom faces of the housing are generally semi-circular in shape, the back face of the housing is generally rectangular in shape, and the front face of the housing is generally semi-cylindrical in shape with a concavity facing towards the back face of the housing. In this preferred embodiment, the top and bottom faces of the housing are substantially planar and extend substantially parallel to one another. The back face of the housing is substantially planar and is extended substantially perpendicular to the top and bottom faces of the housing. Also in this preferred embodiment, the front face of the housing has a center axis extending substantially perpendicular to the top and bottom faces of the housing. The front and back faces of the housing come together at a pair of substantially straight sides extending substantially perpendicular to the top and bottom faces of the housing. Ideally, the housing comprises a resilient rigid plastic material.

Figure 3:
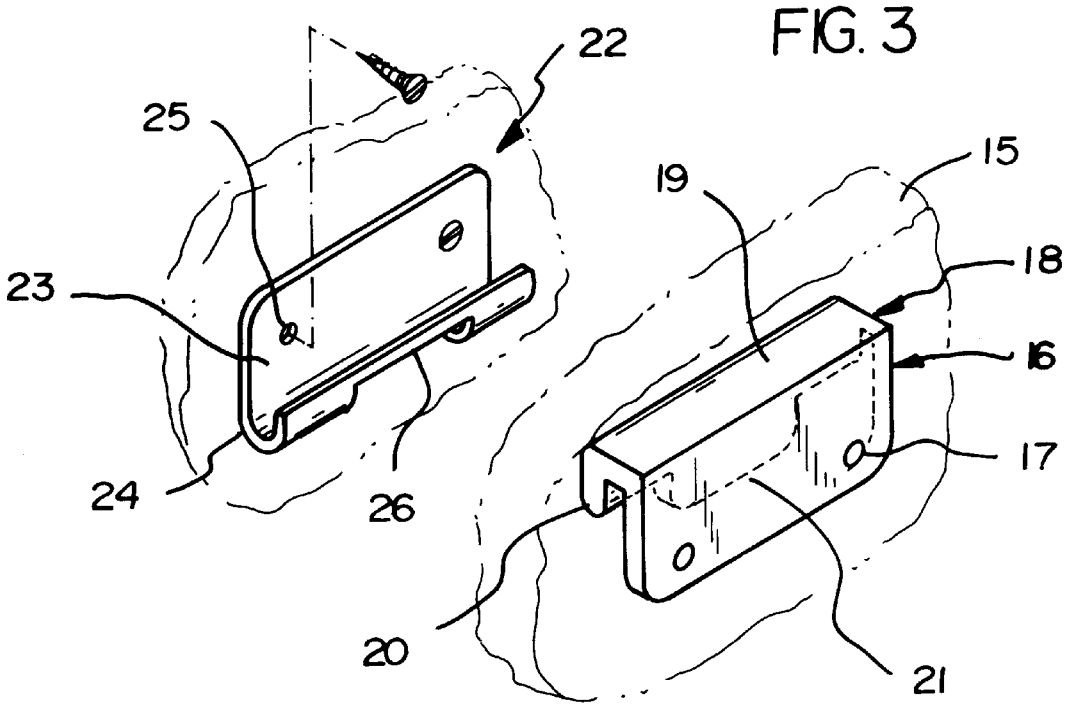
FIG. 3 is a schematic perspective view of the mounting bracket and hanging bracket of the present invention.

The back face of the housing is designed for mounting to a generally vertical support structure such as a wall structure. With reference to FIG. 3, preferably the housing is mounted to the vertical support structure with a mounting bracket 16 coupled to the back face of the housing by a pair of fasteners extended through a pair of holes 17 in the mounting bracket. The mounting bracket has an upper mounting flange 18 outwardly extending therefrom. The upper mounting flange of the mounting bracket is generally L-shaped and has a generally horizontal upper portion 19 and a generally vertical lower portion 20 downwardly depending from the upper portion of the upper mounting flange. The lower portion of the upper mounting flange is also spaced apart from the back face of the housing. Preferably, the lower portion of the upper mounting flange has a mounting tab 21 downwardly extending therefrom.

A generally J-shaped hanging bracket 22 is provided for mounting to the vertical support structure. The hanging bracket has a generally planar upper portion 23 and an arcuate lower portion 24. The upper portion of the hanging bracket is coupled to the vertical support structure by a pair of fasteners extended through a pair of holes 25 in the upper portion of the hanging bracket. The lower portion of the hanging bracket preferably has a mounting slot 26 therein.

To mount the mounting bracket to the hanging bracket, the upper mounting flange of the mounting bracket is rested on the lower portion of the hanging bracket. The mounting tab of the upper mounting flange is inserted into the mounting slot of the lower portion of the hanging bracket to help hold the mounting bracket securely to the hanging bracket.

As illustrated in FIG. 1, the front face of the housing has front opening 27 into the housing. The front opening of the front face of the housing has an outer periphery comprising spaced apart arcuate upper and lower edges, and a spaced apart pair of side edges extending between the upper and lower edges of the front opening. The upper and lower edges of the front opening preferably lie in planes substantially parallel to the top and bottom faces of the housing with the side edges of the front opening extending substantially perpendicular to the top and bottom faces of the housing and substantially parallel to the sides of the housing.

Figure 2:
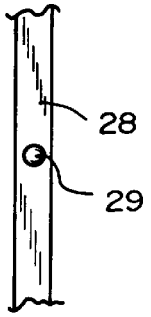
FIG. 2 is a schematic partial side view of the indentation of the door of the present invention taken from the vantage of line 2—2 of FIG. 1.

A generally semi-cylindrical door 28 substantially closes the front opening of the housing. The door is pivotally coupled by hinges to one of the side edges of the front opening of the housing. The door is also preferably detachably attached to the other of the side edges of the front opening of the housing when the door is closing the front opening. Ideally, the door has an indentation 29 therein as illustrated in FIG. 2 and the housing has a resilient extent 30 adjacent the other side edge of the front opening. In use, the extent is removably inserted into the indentation of the door to detachably attach the door to the other side edge of the front opening. The door also preferably has a handle 31 coupled thereto to permit a user to pivot the position of the door to open and close the front opening of the housing.

A plate 32 is provided in the housing. The plate has substantially planar upper and lower faces 33,34, substantially straight and parallel front and back edges 35,36, and a pair of substantially straight and parallel side edges 37,38 extending substantially perpendicular between the front and back edges of the plate. The back edge of the plate is detachably attached to the back face of the housing to permit removal of the plate for easy cleaning of the plate. Preferably, the upper and lower faces of the plate lie in planes generally parallel to the top and bottom faces of the housing when the plate is attached to the back face of the housing.

Figure 4:
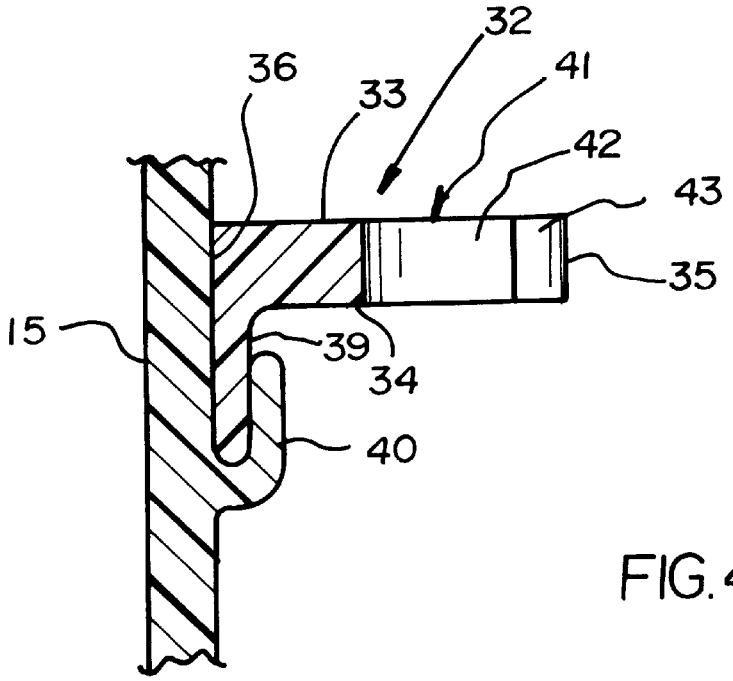
FIG. 4 is a schematic cross sectional view of the mounting of the plate to the housing of the present invention.

Preferably, the plate is detachably attached to the back face of the housing with a mounting flange 39 downwardly extending substantially perpendicularly from the lower face of the plate along the back edge of the plate. As illustrated in FIG. 4, the back face of the housing has a resiliently deflectable generally J-shaped mount 40 extending into the housing. The mount defines an upper channel between the mount and the back face of the housing. The mounting flange of the plate is inserted into the upper channel such that the mounting flange is releasably held between the mount and the back face of the housing.

The plate has a plurality of spaced apart holding slots 41 extending therethrough between the upper and lower faces of the plate adjacent the front edge of the plate. Each of the holding slots has an outer periphery comprising a generally circular portion 42 spaced apart from the front edge of the plate and a generally rectangular portion 43 continuous with the associated circular portion of the respective holding slot and extending between the associated circular portion and the front edge of the plate. In use, the holding slots each are designed for extending a toothbrush therethrough such that the toothbrush is extended generally vertical in the housing.

Preferably, the top face of the housing has a plurality of vent apertures 44 therethrough to permit passage of air into the housing. Similarly, the bottom face of the housing has a plurality of drain apertures 45 therethrough to permit draining of fluid out of the housing from wet toothbrushes therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush cabinet, comprising:

a housing having spaced apart top and bottom faces, and front and back faces;

said front face of said housing having front opening into said housing;

a door closing said front opening of said housing;

said door being pivotally coupled to said housing;

a plate being provided in said housing, said plate having upper and lower faces, front and back edges, and a pair of side edges extending between said front and back edges of said plate;

said back edges of said plate being detachably attached to said back face of said housing:

said plate having a plurality of spaced apart holding slots extending therethrough between said upper and lower faces of said plate adjacent said front edge of said plate;

each of said holding slots having an outer periphery comprising a generally circular portion spaced apart from said front edge of said plate and a generally rectangular portion continuous with the associated circular portion of the respective holding slot and extending between the associated circular portion and said front edge of said plate; and wherein said plate has a mounting flange downwardly extending substantially perpendicularly from said lower face of said plate along said back edge of said plate, wherein said back face of said housing has a resiliently deflectable generally J-shaped mount extending into said housing, said mount defining an upper channel between said mount and said back face of said housing, and wherein said mounting flange of said plate is inserted into said upper channel such that said mounting flange is releasably held between said mount and said back face of said housing.

2. The toothbrush cabinet of claim 1, wherein said top face of said housing has a plurality of vent apertures therethrough to permit passage of air into said housing.

3. The toothbrush cabinet of claim 1, wherein said bottom face of said housing has a plurality of drain apertures therethrough to permit draining of fluid out of said housing.

4. The toothbrush cabinet of claim 1, wherein said top and bottom faces of said housing are generally semi-circular in shape, said back face of said housing is generally rectangular in shape, and said front face of said housing is generally semi-cylindrical in shape and having a concavity facing towards said back face of said housing.

5. The toothbrush cabinet of claim 1, further comprising a mounting bracket being coupled to said back face of said housing, said mounting bracket having an upper mounting flange outwardly extending therefrom, further comprising a generally J-shaped hanging bracket being adapted for mounting to the vertical support structure, said hanging bracket having a generally planar upper portion and an arcuate lower portion, and wherein said upper mounting flange of said mounting bracket is rested on said lower portion of said hanging bracket.

6. The toothbrush cabinet of claim 5, wherein said upper mounting flange of said mounting bracket is generally L-shaped and having a generally horizontal upper portion and a generally vertical lower portion downwardly depending from said upper portion of said upper mounting flange, said lower portion of said upper mounting flange being spaced apart from said back face of said housing.

7. The toothbrush cabinet of claim 6, wherein said lower portion of said upper mounting flange has a mounting tab downwardly extending therefrom, wherein said lower portion of said hanging bracket has a mounting slot therein, and wherein said mounting tab of said upper mounting flange is inserted into said mounting slot of said lower portion of said hanging bracket.

8. A toothbrush cabinet, comprising:

a housing having spaced apart top and bottom faces, and front and back faces;

said top and bottom faces of said housing being generally semi-circular in shape, said back face of said housing being generally rectangular in shape, said front face of said housing being generally semi-cylindrical in shape and having a concavity facing towards said back face of said housing;

said top and bottom faces of said housing being substantially planar and extending substantially parallel to one another;

said back face of said housing being substantially planar and being extended substantially perpendicular to said top and bottom faces of said housing;

said front face of said housing having a center axis extending substantially perpendicular to said top and bottom faces of said housing;

said front and back faces of said housing coming together at a pair of substantially straight sides extending substantially perpendicular to said top and bottom faces of said housing;

said back face of said housing being adapted for mounting to a generally vertical support structure;

a mounting bracket being coupled to said back face of said housing, said mounting bracket having an upper mounting flange outwardly extending therefrom;

said upper mounting flange of said mounting bracket being generally L-shaped and having a generally horizontal upper portion and a generally vertical lower portion downwardly depending from said upper portion of said upper mounting flange, said lower portion of said upper mounting flange being spaced apart from said back face of said housing;

said lower portion of said upper mounting flange having a mounting tab downwardly extending therefrom;

a generally J-shaped hanging bracket being adapted for mounting to the vertical support structure;

said hanging bracket having a generally planar upper portion and an arcuate lower portion;

said lower portion of said hanging bracket having a mounting slot therein;

said upper mounting flange of said mounting bracket being rested on said lower portion of said hanging bracket, said mounting tab of said upper mounting flange being inserted into said mounting slot of said lower portion of said hanging bracket;

said front face of said housing having front opening into said housing, said front opening of said front face of said housing having an outer periphery comprising spaced apart arcuate upper and lower edges, and a spaced apart pair of side edges extending between said upper and lower edges of said front opening;

said upper and lower edges of said front opening lying in planes substantially parallel to said top and bottom faces of said housing, said side edges of said front opening being extended substantially perpendicular to said top and bottom faces of said housing and substantially parallel to said sides of said housing;

a generally semi-cylindrical door substantially closing said front opening of said housing;

said door being pivotally coupled to one of said side edges of said front opening of said housing;

said door being detachably attached to the other of said side edges of said front opening of said housing when said door is closing said front opening, wherein said door has an indentation therein, said housing having a resilient extent adjacent said other side edge of said front opening, said extent being removably inserted into said indentation of said door to detachably attach said door to said other side edge of said front opening;

said door having a handle coupled thereto to permit a user to pivot the position of the door to open and close the front opening of the housing;

a plate being provided in said housing, said plate having substantially planar upper and lower faces, substantially straight and parallel front and back edges, and a pair of substantially straight and parallel side edges extending substantially perpendicular between said front and back edges of said plate;

said back edges of said plate being detachably attached to said back face of said housing, said upper and lower faces of said plate lying in planes generally parallel to said top and bottom faces of said housing;

said plate having a mounting flange downwardly extending substantially perpendicularly from said lower face of said plate along said back edge of said plate;

said back face of said housing having a resiliently deflectable generally J-shaped mount extending into said housing, said mount defining an upper channel between said mount and said back face of said housing;

said mounting flange of said plate being inserted into said upper channel such that said mounting flange is releasably held between said mount and said back face of said housing;

said plate having a plurality of spaced apart holding slots extending therethrough between said upper and lower faces of said plate adjacent said front edge of said plate;

each of said holding slots having an outer periphery comprising a generally circular portion spaced apart from said front edge of said plate and a generally rectangular portion continuous with the associated circular portion of the respective holding slot and extending between the associated circular portion and said front edge of said plate;

said holding slots each being adapted for extending a toothbrush therethrough such that the toothbrush is extended generally vertical in said housing;

said top face of said housing having a plurality of vent apertures therethrough to permit passage of air into said housing; and said bottom face of said housing having a plurality of drain apertures therethrough to permit draining of fluid out of said housing.

* * * * *